US007726094B2

(12) United States Patent
von Morze-Reichartz

(10) Patent No.: US 7,726,094 B2
(45) Date of Patent: Jun. 1, 2010

(54) SUPPORTING STRUCTURE AND ITS STRUCTURAL MEMBERS

(75) Inventor: Sigrun von Morze-Reichartz, Korschenbroich (DE)

(73) Assignee: Induo Gesellschaft zur Verwertung von Schutzrechten mbH & Co. KG, Korschenbroich (DE)

( * ) Notice: Subject to any disclaimer, the term of this patent is extended or adjusted under 35 U.S.C. 154(b) by 1083 days.

(21) Appl. No.: 11/119,039

(22) Filed: Apr. 29, 2005

(65) Prior Publication Data

US 2005/0252162 A1 Nov. 17, 2005

Related U.S. Application Data

(63) Continuation-in-part of application No. 10/393,484, filed on Mar. 20, 2003, now abandoned, which is a continuation of application No. 09/341,814, filed on Sep. 21, 1999, now abandoned.

(30) Foreign Application Priority Data

| | | |
|---|---|---|
| Jan. 17, 1997 | (DE) | 197 01 458 |
| Mar. 5, 1997 | (DE) | 197 08 827 |
| Jun. 16, 1997 | (DE) | 297 10 435 U |
| Jul. 14, 1997 | (DE) | 197 30 163 |

(51) Int. Cl.
*E04C 3/00* (2006.01)

(52) U.S. Cl. ..... 52/847; 52/831; 52/834

(58) Field of Classification Search ..... 52/847, 52/834, 831, FOR. 100; 428/542.8, 63
See application file for complete search history.

(56) References Cited

U.S. PATENT DOCUMENTS

| | | | | |
|---|---|---|---|---|
| 1,972,119 | A * | 9/1934 | Wernhardt | 411/456 |
| 3,605,360 | A | 9/1971 | Lindal | |
| 3,742,675 | A * | 7/1973 | Demers | 52/847 |
| 4,615,163 | A * | 10/1986 | Curtis et al. | 52/836 |
| 4,742,663 | A | 5/1988 | Demers | |
| 5,050,366 | A * | 9/1991 | Gardner et al. | 52/847 |

(Continued)

FOREIGN PATENT DOCUMENTS

| | | | |
|---|---|---|---|
| AU | 1392270 | A | 10/1971 |

(Continued)

OTHER PUBLICATIONS

Lantos article, "Glulam Timber Beams Stiffened with Steel", London, UK, Aug. 28, 1964, p. 260, document index No. XP-002066827.

(Continued)

*Primary Examiner*—David Dunn
*Assistant Examiner*—Joshua Ihezie
(74) *Attorney, Agent, or Firm*—Connolly Bove Lodge & Hutz LLP

(57) ABSTRACT

A wooden beam for a supporting framework has at least two supporting members at least partially made of wood and defining together a continuous hollow cavity, and at least one shear connector located in the hollow cavity and characterized by a plurality of connection options, with the shear connector having its outside end set back with respect to an adjacent and face of the beam by a length corresponding to a forward wood length defined by a load applied to the beam.

13 Claims, 13 Drawing Sheets

U.S. PATENT DOCUMENTS

| | | | | |
|---|---|---|---|---|
| 5,410,854 | A | 5/1995 | Kimmell | |
| 5,871,849 | A * | 2/1999 | Lepine | 428/542.8 |
| 6,357,197 | B1 * | 3/2002 | Serino et al. | 52/834 |
| 2003/0182891 | A1 * | 10/2003 | Reichartz | 52/720.1 |

FOREIGN PATENT DOCUMENTS

| | | | |
|---|---|---|---|
| CA | 2010740 | A1 | 8/1991 |
| CH | 454411 | A5 | 4/1968 |
| CH | 673305 | A5 | 2/1990 |
| DE | 855900 | C1 | 11/1952 |
| DE | 2021028 | A | 10/1970 |
| DE | 2522911 | A1 | 12/1976 |
| DE | 8315186 | U1 | 5/1985 |
| DE | 3638499 | A1 | 5/1988 |
| EP | 0127095 | A2 | 12/1984 |
| EP | 0159452 | A1 | 10/1985 |
| EP | 159452 | A1 * | 10/1985 |
| FR | 520776 | A | 6/1921 |
| FR | 2165699 | A | 8/1973 |
| GB | 119525 | A | 10/1918 |
| GB | 2049857 | A | 12/1980 |
| JP | 55171504 | | 11/1980 |
| JP | 1287354 | A | 11/1989 |
| JP | 4143352 | A | 5/1992 |
| WO | WO8703634 | A1 | 6/1987 |

OTHER PUBLICATIONS

Monck article, "Holzbau", Verlang fur Bauwesen Berlin-Munich, 1993, pp. 191-197.

* cited by examiner a)

b)

c)

d)

e)

SUPPORTING STRUCTURE AND ITS STRUCTURAL MEMBERS

RELATED APPLICATIONS

This application is a continuation-in-part of application Ser. No. 10/393,484 filed Mar. 20, 2003, now abandoned, which is a continuation of application Ser. No. 09/341,814 filed Sep. 21, 1999, now abandoned, which is U.S. National Stage entry under 35 U.S.C. §371 based on PCT/EP98/00235, filed Jan. 17, 1998, which claims priority to German Patent Application Nos. 19701458.5, filed Jan. 17, 1997; 19708827.9, filed Mar. 5, 1997; 29710435.7, filed Jun. 16, 1997; and 19730163.0, filed Jul. 14, 1997.

BACKGROUND OF THE INVENTION

1. Field of the Invention

This invention concerns a wooden beam for a supporting framework and its constructional elements, where the wooden beam consists of at least two supporting members at least partially made of wood with a continuous hollow space joined to form one unit, with at least one shear connector with connection options inside the hollow space, as well as the shear connector itself, the supporting framework that can be produced with at least one such beam and a device for inserting at least one shear connector into a supporting member.

2. Description of the Prior Art

Supporting frameworks are known from many fields. Steel and reinforced concrete supporting framework constructions shall be mentioned here only as examples and are used in various fields, from erecting buildings to construction of bridges.

However, a disadvantage of these supporting framework constructions is that they are very expensive to manufacture—for example, assembly is commonly associated with cost-intensive welding work and subsequent pouring of concrete and also with regard to the number of different individual parts required, which must also be adapted and assembled in a complicated procedure. Furthermore, such supporting framework constructions can be produced only by a specialist.

Another disadvantage which should not be underestimated is that with the known supporting frameworks, the individual parts must be fixedly joined together and thus repeated use is out of the question, and whenever repairs, if any, are necessary, they can be performed only at enormous expense.

Recently there has been a discernible trend in the construction industry toward increasing use of wood or wood-based materials as a building material in the construction of single-family dwellings. Various supporting systems have been successful in this area. Solid wood, glued laminated girders and other wood-based materials as well as cross-beams are used, that are capable of absorbing and transmitting greater forces with cross sections of the same size.

There have been various proposals for the joints to be used, in particular in the area of the ends of these wooden construction elements. Examples that can be mentioned here include dowels driven across the longitudinal axis of the beam in the area of tongue-and-groove joints, with bolts and additional screw nails or nail connections with cover plates or tenons with cross-driven hard wood dowels or embedded steel T-sections with dowels or tenons, in particular forked mortise and tenon joints and the like.

All these joints have the great disadvantage that the systems constructed with them are expensive to assemble and also require a multitude of individual parts which must also be fitted and assembled in inaccessible positions, often on site and at great effort. As a result, these systems can usually also be assembled only by expert personnel to form an overall supporting framework that can withstand forces and loads.

In addition to this trend toward increased use of wood in the construction industry, there is another trend in this branch of the industry, namely that toward the construction of buildings, in particular single-family dwellings, inexpensively through personal effort and thus to make home ownership accessible to larger portions of society. This is impossible with the known joining systems because they must be manufactured with precision in specially equipped manufacturing sites.

Therefore, the object of this invention is to propose a beam and a supporting framework constructed with its construction elements, in particular shear connectors and connecting parts as well as a method of producing such beams including a device for introducing the shear connectors, which do not have the above-mentioned disadvantages, and instead they are characterized in that their elements can be assembled easily without any complicated additional measures to form a supporting framework, preferably in a detachable manner.

SUMMARY OF THE INVENTION

The feature of this invention whereby the inserted shear connector is set back with respect to the end face of the beam, leading to the so-called "forward wood," causes a much more favorable dissipation of the tensile force into the ring tensile force, because it creates a shallower force cone and a larger peripheral surface area for the transmission of forces, while on the other hand a radially outward directed force component that would promote splitting is dissipated or absorbed over a larger peripheral area.

A sheer connector according to the present invention has a core, which has generally a polygonal cross-section, and a plurality of mandrels which project from the core, penetrating into wood, in a direction transverse to the longitudinal extent of the shear connector and are arranged one after another, with a predetermined spacing therebetween, in a longitudinal direction of the shear connector.

A minimal forward wood length, i.e., a distance by which the shear connector is set back with respect to the beam end face, is determined from a premise that neither the shear connector nor the shear block, which is determined by the shear connector profile or action of the shear connector mandrels, are sheared off, and is calculated from a following equation:

$$a_{1,t} \geq \frac{Rk \cdot \gamma_M \text{wood}}{\gamma_M \text{steel} \cdot f_{v,k} \cdot (2 \cdot t_1 + a_2)} - a_1 \cdot (n-1),$$

wherein Rk is a characteristical load bearing capacity of a totality of mandrels at an end section of the beam where the shear connector is located, $\gamma_M$ wood is a reduction coefficient during bending of wood, $\gamma_M$ steel is a reduction coefficient during bending of steel, (reduction coefficients are determined from tables), $f_{v,k}$ is stress at break at the flanks of a shear block that is defined by a profile of the shear connector.

$t_1$ is an operational length of a mandrel, $a_1$ is a distance between adjacent mandrels in a longitudinal direction of the shear connector, $a_2$ is a distance between adjacent mandrels in a direction transverse to a longitudinal extent of the shear connector, and n—number of mandrels arranged one after another in a direction of wood fibers.

Maintaining a minimal forward wood length prevents contact pressure between the shear connectors themselves and between the shear connector with associated components, such as steel or reinforced concrete, at a connection location. The contact pressure can be caused by movement of the shear connector in a direction toward the end surface of the wooden beam as a result of application of high tension forces when the shear connector comes into a contact with an adjoining, the wooden beam, component. With a flat contact, no transmission of forces is possible.

Wooden beams according to the present invention permit to absorb and transmit not only transverse forces but also dynamic forces, alternating tension and compression forces.

When "wooden beams" are mentioned here, this is understood to refer to any type of wooden supporting element, including supporting elements containing wood, but preferably those suitable for joining with the shear connectors.

These shear connectors, which are sunk in wooden beams in the manner described and claimed below, are characterized in that they provide the possibility of connection—many different embodiments are conceivable, but a standardized inside thread on the end face has proven especially advantageous—leading to a 100% transmission of force between the supporting framework elements and also permitting a simple, time-saving and inexpensive assembly, even in combination with other materials. Additional advantages are presented in the following description.

When a "connecting element" is mentioned below, it is understood to refer to a spatially oriented structural part, preferably made of metal, in particular steels with angle-offset connection options in three dimensions for the above-mentioned wooden beams. When a "joining or connecting node" is mentioned below, it refers to joining multiple connecting parts.

In a preferred embodiment, the connecting part consists of two parallel plates lying in the main plane of the supporting framework, which also forms the floors of individual storeys of a building, for example, namely a base plate and a top plate at a distance from it. So-called end plates are arranged between these two plates, preferably perpendicular to them. The base plate, top plate and end plate each have different connection possibilities for additional connecting elements and/or wooden beams. These may be, for example, boreholes, which are designed to accommodate means for forming screw connections.

In the preferred embodiment, the end plates serve to permit a connection between wooden beams and connecting parts and also among the different connecting parts. In this way, it is possible to create a supporting framework which forms a main plane with large dimensions. The base plate and top plate make it possible to join the wooden beams which form a supporting plane and run perpendicular to the main plane. These supporting planes may be, for example, walls inside a building or they may be expanded to form walls by paneling in a variety of possible forms, while the main planes form the base of the floor for that level.

Essentially any type of detachable joint is suitable for the joints between wooden beams and connecting parts, but screw connections are preferred, because the required elements are available as standard parts in any construction market and therefore special production runs are not necessary, which has a positive effect on the cost of the supporting framework as a whole.

The supporting framework according to this invention can thus be assembled easily, even by a layperson, making it possible for any building owner to construct his own home himself to a not insignificant extent. Only a small number of different construction elements are necessary, namely, the wooden beams and means for producing a joint between the wooden beams and the connecting parts, with these means being integrated into the wooden beam according to this invention.

For such means the invention proposes a shear connector which leads to a surprisingly simple load-bearing joint with a variety of possible embodiments.

The proposal according to this invention, which goes in a completely different direction from the proposed connecting means known in the past permits a type of "internal nailing" for the first time, opening up unforeseen possible applications. Apart from fact that this makes it possible to shorten the connecting means that absorb the load-carrying stresses in a manner that saves on material, the novel connection according to this invention is characterized by a simple design which does not require any additional securing elements.

Connecting elements for use on different construction elements, namely different in particular with regard to the shape and material, are known in various embodiments. They are especially important in particular in construction systems which are exposed to high loads, as is the case, for example, with buildings and the like. Various types of supporting systems have been successful here, and must meet various requirements with regard to the materials used and the forces and loads they must withstand. This is true primarily with regard to the load-bearing capacity of the individual parts and the overall structure—also taking into account the expediency for the overall visual impression and details.

A typical example of the constructions discussed here would be wooden buildings, where beams or similar supporting elements are joined together to form load-bearing wall, floor and/or roof supporting frameworks. Various combinations of materials can also be used, i.e., wood as a construction material may also be combined with concrete as a filling compound or with plastic or metal parts. The material wood may consist of solid wood, glued laminated girders or other wooden materials, but solid wood in the form of round timbers, beams, squared timbers, boards and recently cross-beams may be used, as they are capable of absorbing and transmitting relatively high forces in comparison with the size of their cross section.

Joints, in particular in the area of the ends of the construction elements, have been developed and introduced into practice in a variety of forms. Here shall be mentioned only as an example a few known possibilities, e.g., dowels with bolts driven in across the longitudinal axis of the beam in the area of tongue-and-groove joints and additional screw nails or nail connections with cover plates or tenons with crosswise hard wood dowels or embedded steel T-sections with dowels or tenons, in particular forked mortise and tenon joints and the like. End connections can also be achieved in a known way by means of a so-called beam butt joint, where the beam sides are covered with carrying parts on both sides in the area of their ends for the transmission of force by means of transverse dowels of a special design.

All the joints suffer from the considerable disadvantage that systems constructed with them are very expensive to manufacture—e.g., due to the tenons and grooves to be molded onto the supporting parts to be joined in the case of butt joints—and also with regard to the multitude of individual parts required, which must also be fitted and installed in inaccessible positions, frequently on site, in a time-consuming and expensive operation. In addition, these known joining systems can be implemented only in such a way that they are visible to the outside, unless additional lamination measures are implemented in the respective areas, e.g., in the area of the cover plates or the end faces of the dowels.

In an attempt to at least minimize these drawbacks, there have been proposals for providing an end joint for the above-mentioned supporting members, in particular of wooden beams. These include a dowel connection which works with steel shear connectors glued into the wooden materials. To do so, first the end must be routed out to form a countersunk area for inserting the dowel and gluing it there, so that it can be engaged with an appropriate attachment as a connecting means. Apart from the fact that the depth of the countersunk area and thus the length of the dowel and thus in turn the load-bearing capacity and in particular the tensile strength are limited because of the need for providing a reliable adhesive layer and because of the tools and dies, the expense in the production of this joining system is not insignificant and requires additional labor steps in the production of this supporting member, namely routing out a suitable bore in the end face and then gluing a suitable dowel in it.

With another known proposal, so-called shear connectors which require dowels inserted across the longitudinal axis of the supporting member are used. This known system consists of five basic elements, namely dowels, shear connector bodies, casting compound, connecting screw and welding sleeve. This known system thus has at least the disadvantages described above, but in addition, the filling with casting compound and the above-mentioned visual impairment should also be mentioned.

European Patent No. 159,452 A1 describes and presents node point connections for wooden timbers suitable for framework or latticework construction, i.e., only for tension members and compression members. In the state of the art, as shown by FIG. 3 in European Patent No. 159,452 A1, for example, a specific recess must be created in the beam parts in an additional operation, with the length and depth being adapted to the connecting element. In addition, special joining measures are necessary in the end face area of the beam, but they make the force transmission conditions complicated and unreproducible.

This invention is characterized in particular in that its elements are not visually apparent without requiring any additional measures, and at the same time, the number of individual parts required for this connection is minimized and the installation effort and expense are minimized.

In addition to the simplicity of the connecting systems proposed with this invention, in particular due to the installation of the new shear connector, these systems are characterized by an extraordinarily high efficiency of 100%

The term "cross-beam" as used here is understood to refer to a beam which is formed by splitting one or more tree trunks longitudinally and turning the parts about their longitudinal axis and then joining these parts to form a new beam, with the curved surfaces which are then on the inside, but originally formed the outside surface of the tree(s), forming an essentially central opening extending longitudinally through the cross-beam.

Through the use of a cross-beam as provided in a preferred embodiment according to the present invention, this yields surprising advantages, consisting in particular of the fact that in addition to saving on wood and minimizing shrinkage cracks while at the same time providing a more resistant outside area, the connecting element is arranged on the inside and thus is in the plane which does not transmit force (neutral fiber), relative to the beam, which is actually an unusual situation statically, because normally one connecting element would instead be provided in each of the four corners of a cross-beam, for example, as also shown by known types of cross-beam joints, but not at the center. With the joining system according to the present invention, the connecting element is located in an unusual plane from a static standpoint and is thus not itself exposed to any bending forces.

In addition, this invention makes use of the fact that in a preferred embodiment a central axial recess which is present anyway with a cross-beam is utilized for insertion of the shear connector. When using a glued laminated girder, for example, for the beam, at least one continuous groove is provided in at least one supporting member part in one additional operation according to this invention.

Depending on the dimensions and the spatial givens as well as the load requirements, various designs can be implemented, some of them with enormous advantages. This is true of the shear connector itself as well as the supporting member, namely with regard to the shape and the material of which the shear connector is made and the method of connecting the supporting members.

Thus, in its simplest form, the core of the shear connector may be in the shape of a rod and the mandrels may be designed with a smooth surface. If, in another embodiment, the core is not designed to be linear but instead is wavy or undulating, this would yield an even more secure hold, with the result that the shear connector could be kept shorter. In this sense, a further improvement can be achieved by providing the core surface with grooving or with elevations. Various different embodiments are also possible with regard to the cross-sectional shape of the core; for example, the core may have a round cross section, in particular a circular cross section, or it may have a polygonal cross section, in particular a square or triangular cross section.

The connection possibilities provided on at least one end of the core can also be designed in many conceivable ways, but an inside thread on the end of at least one end of the core has proven to be especially advantageous. For example, a threaded stem or the like may be screwed into this inside thread, and it may also have connecting elements on its free end, or it may be designed as a hook, ball, knob, eyelet or the like. It is also possible within the scope of this invention to provide an outside thread at the end of the core or to have a threaded pin with a smaller diameter than the diameter of the core molded onto the end. In addition, the shear connector may be inserted into a construction element to be joined to at least one other construction part, optionally also extending crosswise through the beam.

In the simplest embodiment, the mandrels are joined in one piece with the core, and they may be distributed uniformly or irregularly on the outside surface of the core. Different variants are also possible with regard to their axial orientation, depending on the given requirements, but with regard to the method of inserting the shear connectors into the supporting member to be described in detail below, it has proven advantageous in the manufacture of the joining system to have the axes of the mandrels run perpendicular to the longitudinal axis of the core, in particular with half the number of mandrels running in one direction and the other half running in the opposite direction.

If the mandrels are oriented in parallel to one another, this yields the advantage that for insertion (pressing) of the shear connector into the supporting member, the force to be applied may be relatively low. The mandrels may be arranged in parallel rows on the outside surface of the core along its longitudinal axis, with the mandrels of one row being offset to the mandrels of at least one adjacent parallel row.

The number of rows of mandrels pointing in each of the two directions indicated above can be varied as needed, but four rows pointing in one direction have proven advantageous with a diamond-shaped cross section or in particular a square cross section of the core, again with two rows on each of the side faces of the square. In addition, the rows of mandrels may run straight and parallel to the longitudinal axis of the core, but they may also run diagonally to it.

As mentioned above, in the simplest embodiment, the mandrels have a smooth surface; however, the surface may also have steps, with at least one undercut on each mandrel, the undercut being designed to encircle the mandrel. However, the surface may be designed like a drill nail, having a peripheral ridge, in particular in the form of a spiral, or it may have a sawtooth shape.

The mandrels are preferably joined in one piece with the core, which is the case in particular when the shear connector is produced by casting iron, annealed cast iron, cast steel, brass or aluminum, for example; production from ceramics is also possible. The shear connector according to this invention may also be made of sheet metal. On the whole, suitable production methods include in particular pressing, stamping, compression molding, edging, nibbling, milling, lathing and/or suitable shaping methods, depending on the material and requirements.

As mentioned above, the shear connector according to this invention makes possible a joining system with which it is possible to create a connection of supporting members at the end faces. The more or less internal nailing of the shear connector in the supporting member as mentioned in this connection is achieved by the fact that the shear connector(s) is or are inserted or impressed or forced into the supporting member. The supporting members in question are thus designed so that they consist of multiple component elements, as is the case with the so-called cross-beams, for example, which are glued together from preferably four beam quarters cut to size with a specific orientation of the annual rings to one another, in a manner with which those skilled in the art are familiar, to thereby achieve an especially great load-bearing capacity.

Although this invention is characterized by great advantages, in particular when using cross-beams, other glued wooden construction elements such as standard beams, glued laminated girders and the like into which the shear connectors are pressed in the proper position during the manufacturing process. In the case of the use of this invention with plastic and/or concrete girders, which is also possible, the shear connector is preferably cast into it.

When the terms "beams" or "girders" are used here, this is understood to refer to any type of supporting member which is intended for a composite joint.

Various positions are possible for the orientation and position of the shear connectors; in the normal case, each beam will receive one shear connector at each end. For shorter beams or with a transverse insertion of the shear connectors in the beam, which is also possible, the shear connector(s) may extend throughout the entire length or thickness of the beam. A shear connector extending crosswise through the beam is also recommended at points of intersection, where one or more other beams, each of which is joined at the end to the shear connector arranged at the point of intersection, are connected.

The setback position of the shear connector according to this invention results in a so-called "forward wood" which further increases the effect achieved with the shear connector, i.e., effectively securing it to prevent it from being pulled out, and at the same time creating a better distribution of the reactive forces in the area of the ends of the girder in a load case, thus creating optimum connections.

Depending on the load case, the shear connector(s) lie(s) in at least one plane of symmetry; however, they may also be arranged in the tension zone at a sufficient distance from the side faces of the beam. In addition, an arrangement of several shear connectors one above the other, preferably in a parallel alignment, is also possible to advantage.

As mentioned above, the joining system according to this invention is suitable for a variety of constructions, such as wood-wood, wood-steel and/or wood-steel-concrete constructions, and also, of course, in combination with plastic as a supporting member and in other combinations of materials of such construction elements of composite materials in addition to those listed above.

With this invention, which leads to 100% efficiency in transmission of forces, a considerable volume of wood is spared in an economical and advantageous manner, because the dimensions and cross sections of the woods used in the respective constructions can now be kept thinner. In addition, assembly of the constructions—even in the combination of different materials—is very simple and can be accomplished in a time-saving manner. Thus, this eliminates the need for large and expensive hoists and cranes, which are necessary with constructions using wooden beams, for example, because now due to their thinner design they can be lifted and installed by two workers. Due to its simple design, the production of the shear connector according to this invention is also inexpensive and can also be accomplished industrially as mass-produced articles.

Building constructions which could previously be implemented only at considerable expense, often with great difficult, can now be implemented more easily and inexpensively due to the high efficiency of the joining system according to this invention, and these constructions can also be implemented in other shapes that could not previously be achieved. Insertion of the shear connector during the production process—gluing and then pressing the individual beam pieces—can be accomplished with extreme dimensional accuracy and with visual observation, which is not the case with the above-mentioned proposals for joining ends as discussed above, because with them, the dowel or shear connector must be inserted into a predrilled blind hole where no visual observation is possible and then must be glued or cross-doweled, again without visual observation. On the other hand, the beam parts with the present invention are glued together to form a complete beam so that insertion of the shear connector which has previously been dipped in glue is performed in an intermediate stage, e.g., when the two lower halves of a cross-beam are glued, at which point the shear connector can then be positioned accurately, optionally reproducibly with the help of simple laser techniques, even with millimeter precision. As soon as the shear connector has been inserted appropriately, receiving holes for the mandrels of the shear connectors can be predrilled to fix their positions, although this is not absolutely necessary; then the upper beam part, which is in turn composed of two wooden beam parts previously glued together in the case of a cross-beam, is pressed onto the glued surface of the lower beam half, while the shear connector mandrels are inserted or pressed into the upper and lower parts of the beam at the same time; in the case of prepressing the shear connector into the lower half of the beam, which is also possible, this is then pressed to the final depth into the lower beam half during the final gluing. It is thus clear that in contrast with the state of the art, practically no time is required for inserting the shear connector according to this invention.

As shown by the preceding discussion, cross-beams are excellently suited for the joining system according to this invention, because they have an internal hollow channel into which the shear connector core can be inserted optimally due to the course of the external annual rings because of the way in which they are joined.

This also greatly simplifies the logistics in shipping and conveyance, because large-scale constructions need no longer be prepared in the plant, but instead due to the use of the shear connector according to this invention, the individual parts can be screwed together at the construction site with dimensional accuracy and thus shipping costs can be saved due to the fact that shipping is greatly facilitated.

Due to the reliable 100% transmission of force, the static calculations can also be performed more easily and can be typed more easily with regard to the use of certain materials and the dimensions to be provided, and thus specific statics can also be created more easily and thus less expensively.

Ultimately, these advantages will also benefit the building owner, in particular in the case of homeowners, not only from the standpoint of production costs, but also because of the possibility of utilizing simple joining systems to the extent that some of the work, if not all the related work can be performed on one's own initiative.

Finally, the above-mentioned advantages also open up new areas of use of the joining system according to this invention, e.g., in bridge building in addition to the above-mentioned applications.

The present invention also includes an economical method of producing the supporting members provided with such a connecting element, and it should be emphasized here that this method is by no means limited to shear connector of the type described above, but instead is also suitable for introducing other types of anchoring or connecting elements.

With a surprising and advantageous effect, this invention makes use of the fact that in many cases supporting members are composed of multiple parts, as is the case with cross-beams, for example, which are assembled in a known manner from multiple "trunk parts" with—a specific alignment of the fiber, preferably glued together and characterized by especially good load-bearing properties. According to this invention, the insertion of the connecting element is incorporated into the process of assembling the parts of the supporting members. However, it is also possible to apply this invention to other supporting members such as glued laminated girders and also one-piece girders, but the latter would then first have to be broken down into component elements to be able to proceed then according to the present invention.

Cross-beams are especially suitable for the present invention because due to their special method of manufacturing, they have a central recess which, in an advantageous embodiment of this invention, can be utilized for the insertion of the connecting elements, in particular when it is a shear connector according to the type claimed here. When using other supporting members, appropriate recesses must first be introduced without any significant deleterious effect on the excellent properties of the supporting framework to be produced with the help of the shear connector according to this invention.

BRIEF DESCRIPTION OF THE DRAWINGS

The present invention is described in greater detail below on the basis of the accompanying drawings, which illustrate some preferred possible embodiments, showing.

DETAILED DESCRIPTION OF THE PREFERRED EMBODIMENTS

Figure 1:
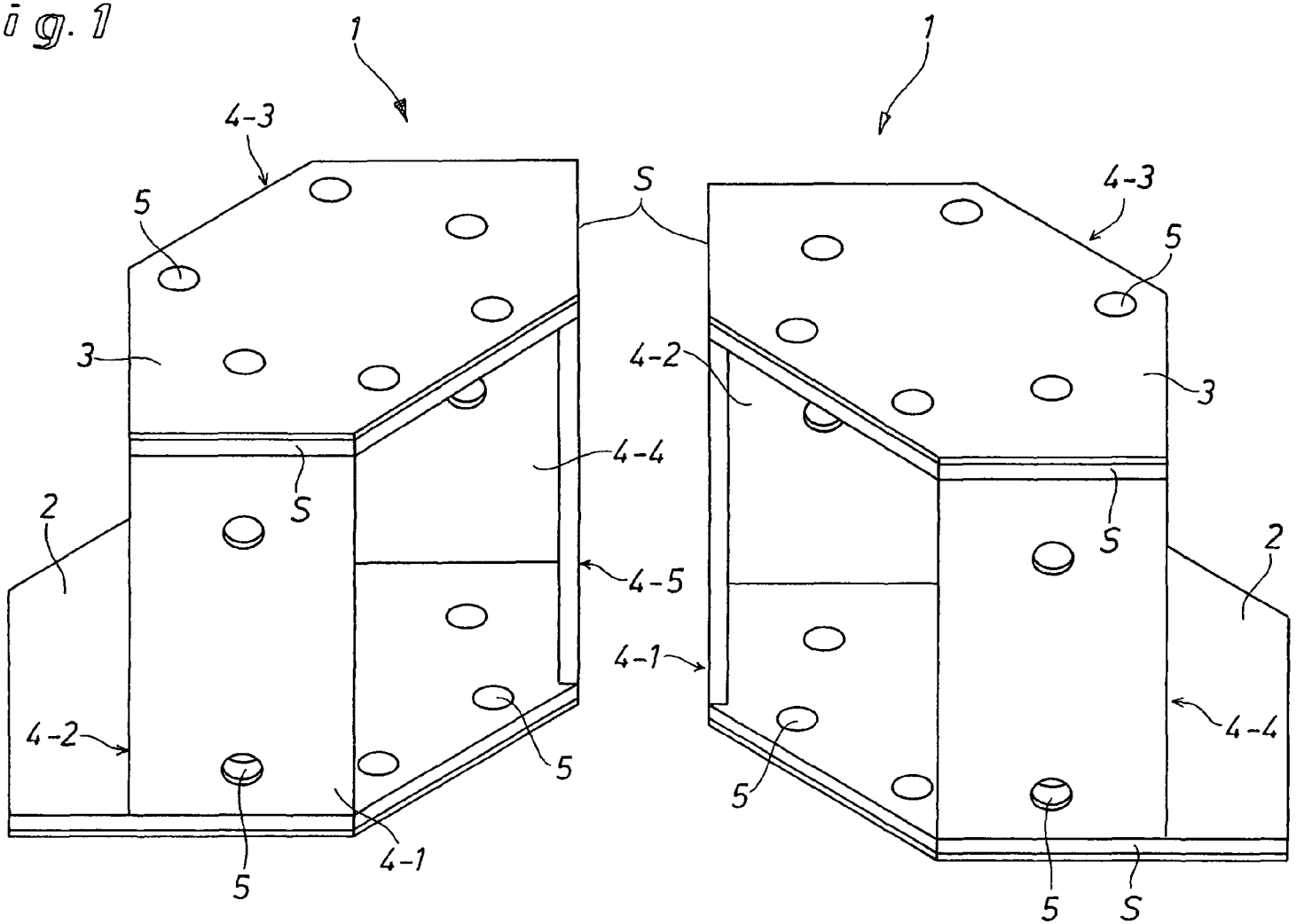
FIG. 1 two connecting parts with boreholes as connecting options.

FIG. 1 shows two connecting parts 1, each composed of a hexagonal base plate 2 and a parallel hexagonal top plate 3. Five rectangular end plates 4-1 through 4-5 are perpendicular to and connected to each base plate 1 to whose free upper end edges top plate 3 is fixedly connected. These plates are preferably made of steel and are welded together.

As FIG. 1 also shows, base plate 2, top plate 3 and end plates 4-1 through 4-5 each have boreholes 5 which serve to detachably attach a connecting part 1 either to one or more additional connecting parts 1 to form a connecting node—this would be possible here by means of end plates 4-1 and 4-5, for example—or they offer the possibility of providing a connection for additional supporting framework members.

Figure 2:
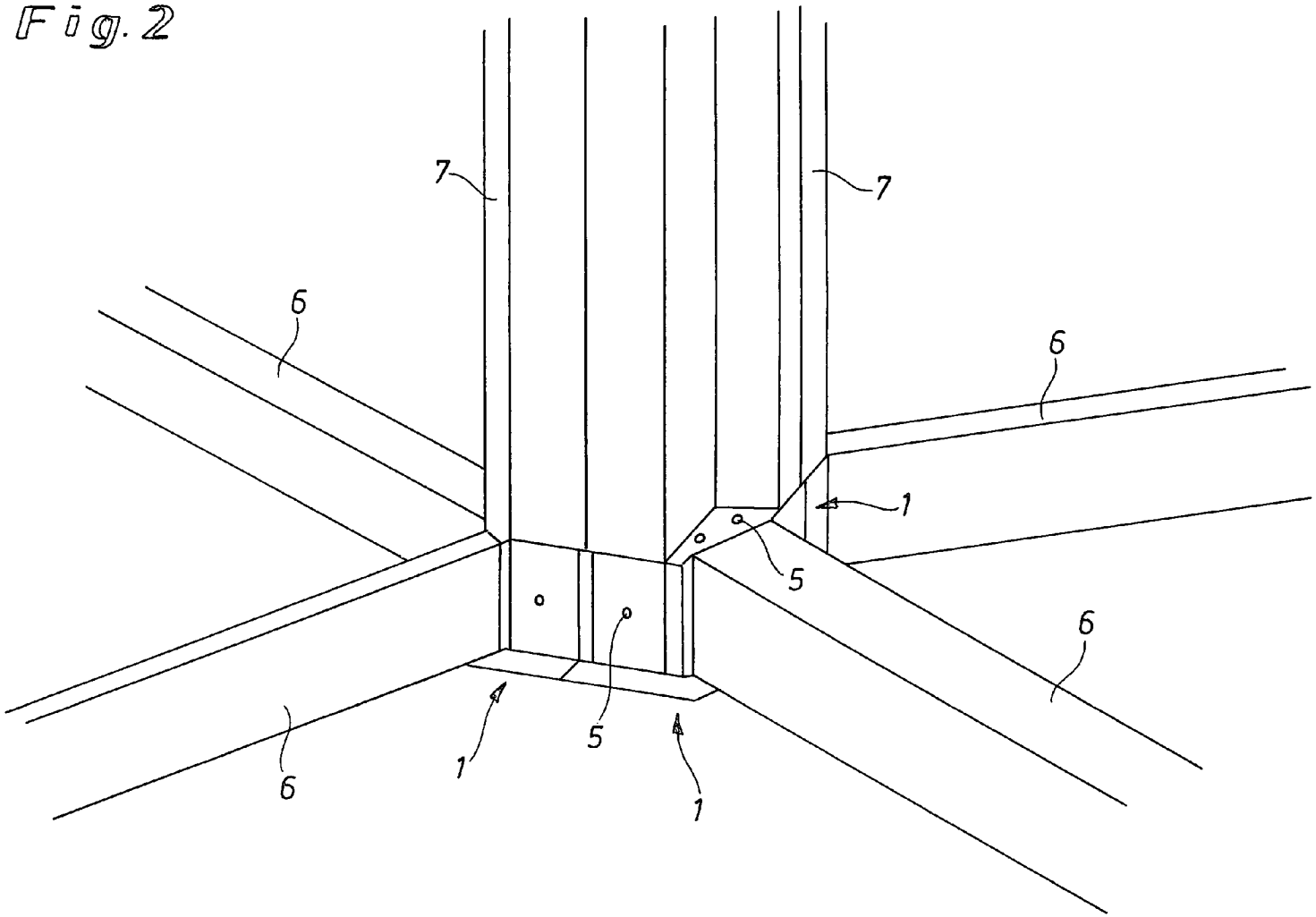
FIG. 2 the connection of four connecting parts with wooden beams attached to them, pointing in three different directions.

FIG. 2 shows some details of the assembly of supporting framework members of a supporting and load-bearing construction, where four connecting parts 1 are linked by their end plates 4-1 and 4-5 so that base plates 2 and top plates 3 point in the same direction, and end plates 4-2, 4-3 and 4-4 offer possible connections for wooden beam 6, which then form the main load-bearing plane and run parallel to base plate 2 and top plate 3. Then only a suitable paneling is necessary to create the floor of a 10 storey, for example.

The end plates 4-2, 4-3 and 4-4 are arranged so that the wooden beams 6 detachably attached to them by screws, for example, each form an angle of 45°. End plates 4-1 and 4-5 are each perpendicular to plates 4-2 and 4-4.

In the case illustrated in FIG. 2, with base plate 2 facing down and top plate 3 facing up, four wooden beams 6 are each mounted at a right angle to one another in the main plane on the end faces of connecting elements 1. The connection between connecting node 1 and wooden beams 6 has been established by means of the shear connectors 13 proposed according to the present invention (shown as an example in FIG. 5). These shear connectors permit an extremely simple method of joining of wooden beam 6 to the connecting parts 1 without any negative visual effect on the finished supporting framework due to visible extra elements. Details on the shear connector and possibilities of its installation are described below.

Wooden beams 7 are mounted on the top plates 3 of the connecting parts 1, and are aligned perpendicular to the wooden beams 6 forming the main planes and they form the supporting planes. The connection between the wooden beams 35 7 and the connecting node are explained here in the same way as described above.

Figure 3:
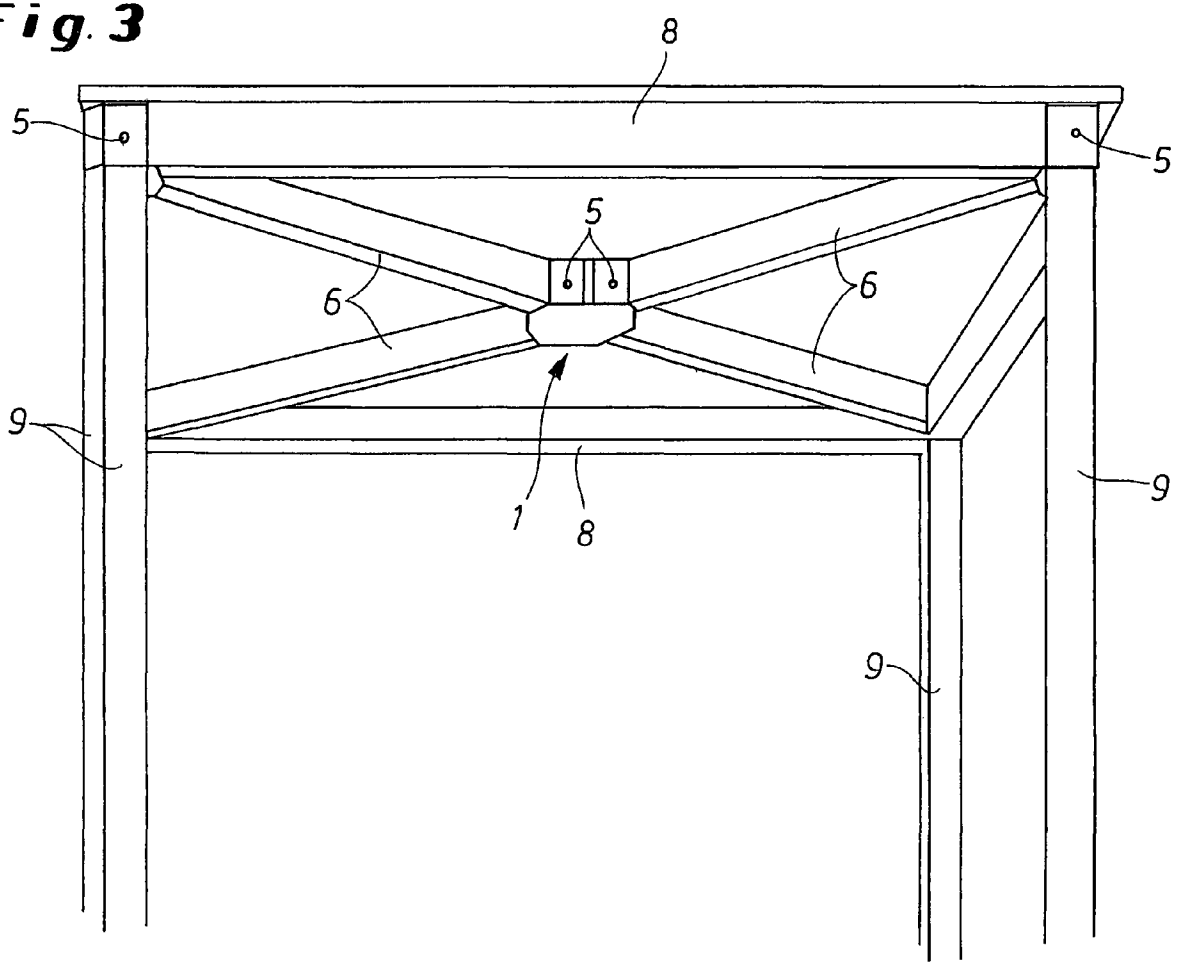
FIG. 3 a detail of an overall supporting framework with a pronounced, relatively large main plane, e.g., one storey.

FIG. 3 shows a detail of an overall supporting framework, having connecting parts 1 with boreholes 5 in its corner areas which face outward, permitting attachment of any desired supporting framework elements and thus continued construction of the supporting framework in any conceivable manner and direction. The main plane of the supporting framework is formed by a central connecting node composed of four connecting parts 1 whose base plates 2 face down and whose top plates 3 face up and by four wooden beams 6, each at a right angle to the other and arranged in a star on the connecting node. Wooden beams 6 are mounted on the connecting node in the same way as already described in conjunction with FIG. 2, namely by the end plate 4-3 of the individual connecting elements 1. At the other end of wooden beam 6, which is the same length, a connecting part 1 is mounted by way of end plates 4-3. Additional wooden beams 8 are also connected to these outer connecting parts 1 by way of end plates 4-2 and 4-4, so that the beams 8 join two connecting parts 1 that are on the outside, thus forming a square as the main plane.

Wooden beams 9 facing downward are mounted on the base plates 2 of the outer connecting parts 1, so that the main plane can be supported on them. The wooden beams 9 form the supporting planes arranged perpendicular to the main plane.

Figure 4:
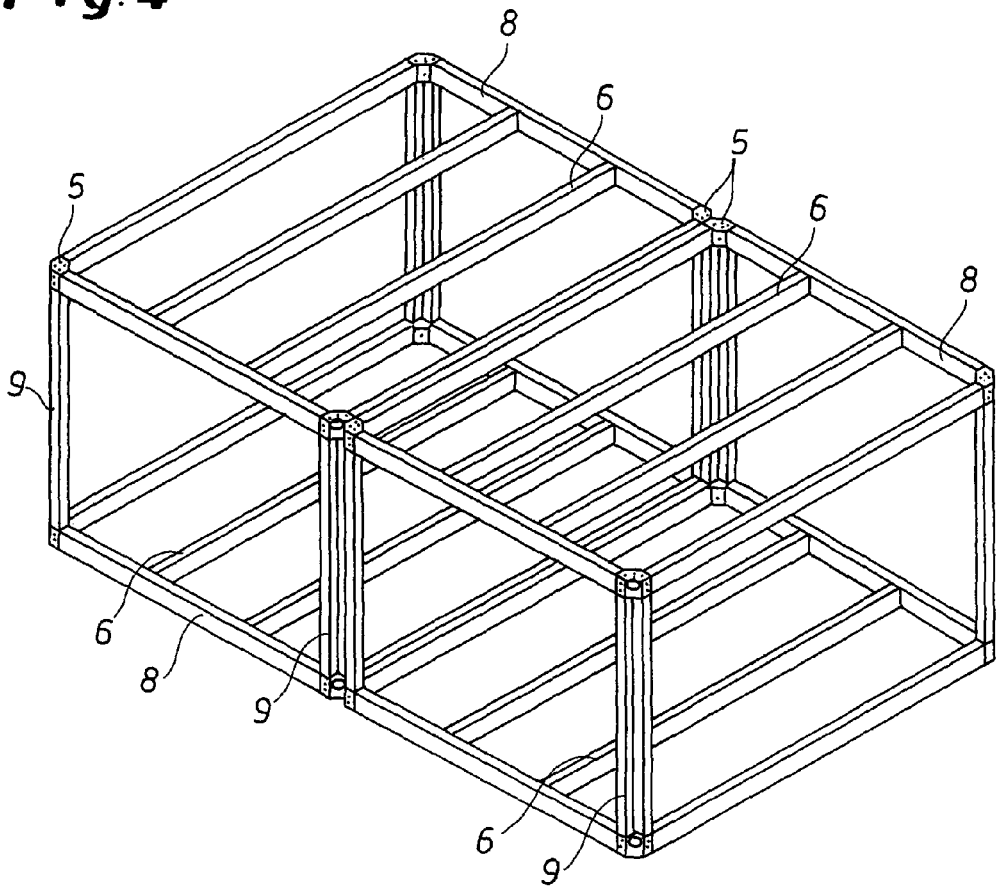
FIG. 4 a perspective view of a supporting framework with two main planes, e.g., of a storey.

FIG. 4 shows a completed embodiment of a supporting framework, whereby in contrast with the embodiment according to FIG. 3, the main planes are formed from beams 6 running parallel to one another. Two main planes run more or less side by side in each stage, so that when there are two adjacent planes, two connecting parts 1 are joined together in their opposing corner areas in the manner illustrated here—with an allocation like that shown in FIG. 1—which shows clearly that this system can be expanded at will without requiring any renovation. The advantage of this embodiment is, among other things, the fact that the respective ceiling construction is produced with parallel ceiling beams, requiring on the one hand only a very simple cutting operation and also on the other hand permitting uniform paneling.

Of course, reinforcing beams which run diagonally can also be used in the supporting planes with suitably oriented connecting parts.

Sheets, for example, can be mounted on the wooden beams 6 of the main plane; top plates 3 of the connecting elements 1 offer connection options facing upward for this purpose. The same thing is also true of any partitions in the supporting planes of the supporting framework.

The top plates and base plates thus represent excellent bearing surfaces for any assembly variation, greatly facilitating assembly, which ultimately requires only screw connections, which can be performed without any expert knowledge.

Figure 5:
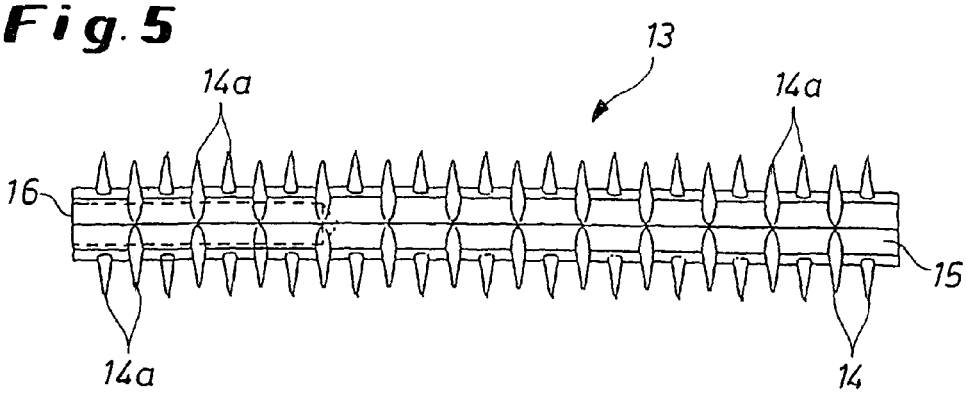
FIG. 5 a top view of a shear connector.

FIG. 5 shows a shear connector 13 according to this invention, namely in the embodiment with an octagonal core cross section and with mandrels 14 and 14*a* arranged in parallel rows with an offset. The recess at the end in the form of an inside thread 16 is also shown with dotted lines.

Figure 6:
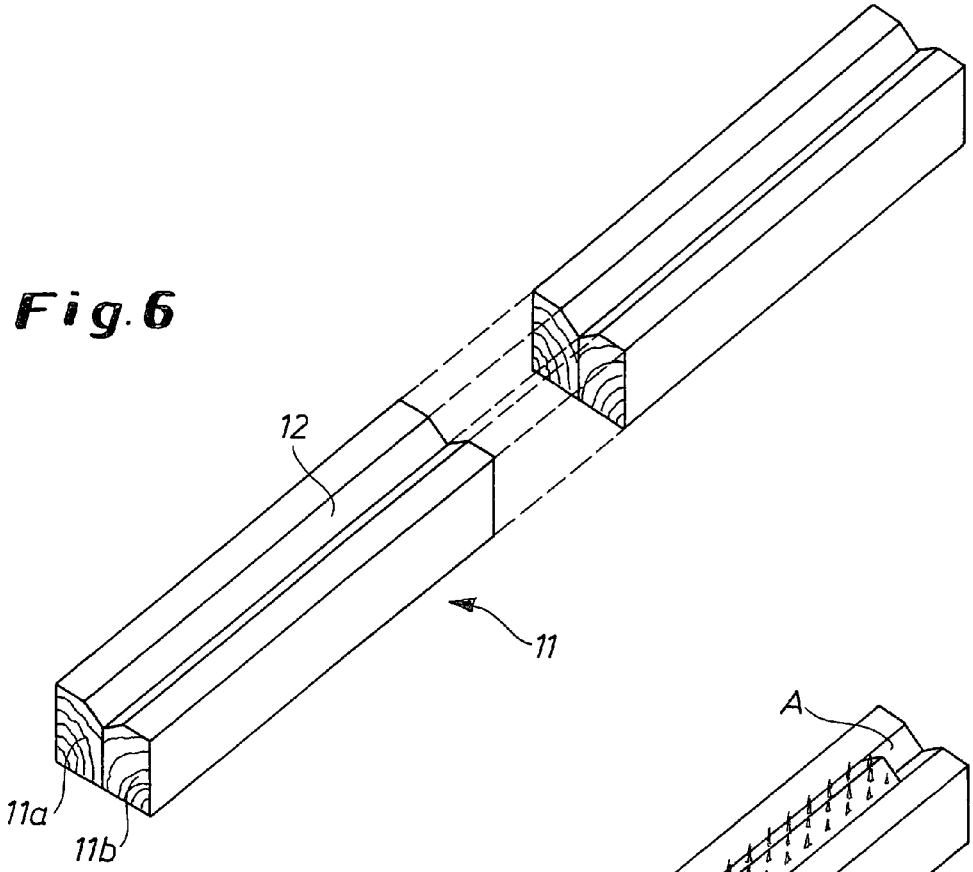
FIG. 6 the lower half of a cross-beam interrupted in the middle longitudinally and glued together.

FIG. 6 shows the lower half 11 of a cross-beam—interrupted in the middle part to permit a shortened representation—consisting of two partial beam pieces 11*a* and 11*b* joined together and glued. The pattern of annular rings at the end is diagramed schematically. A groove-like channel 12 is formed due to the special method of joining the individual partial pieces 11*a* and 11*b* which have been cut to size.

Figure 7:
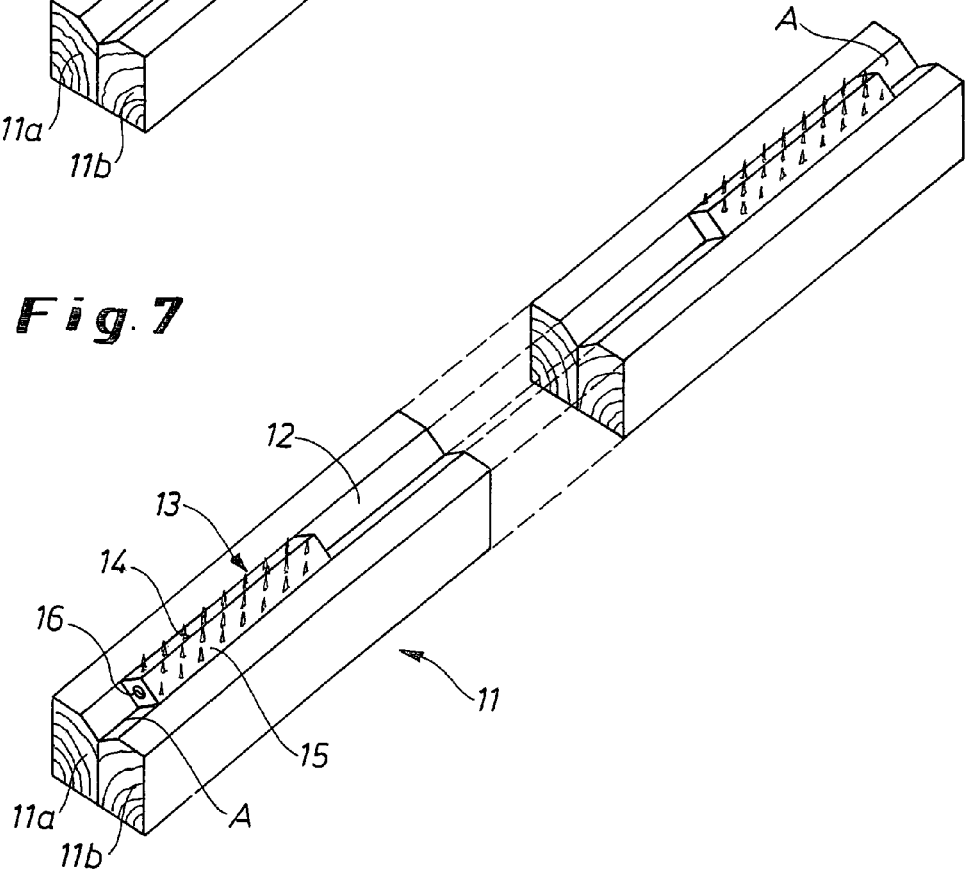
FIG. 7 the cross-beam part according to FIG. 6 with one shear connector inserted at each end.

According to FIG. 7, two shear connector 13 according to this invention are inserted into this channel 12 at each end of the lower beam halves 11 in the embodiment shown here, namely with parallel and perpendicular mandrels 14 on the shear connector core 15 in the embodiment shown here, said core also being provided with a central recess 16 at the end and set back with respect to the beam end face, thus creating the so-called "forward wood" A at both ends. In the preceding part of the description, it was explained in detail how the individual parts of the shear connector 13 according to this invention may be designed and implemented.

Figure 8:
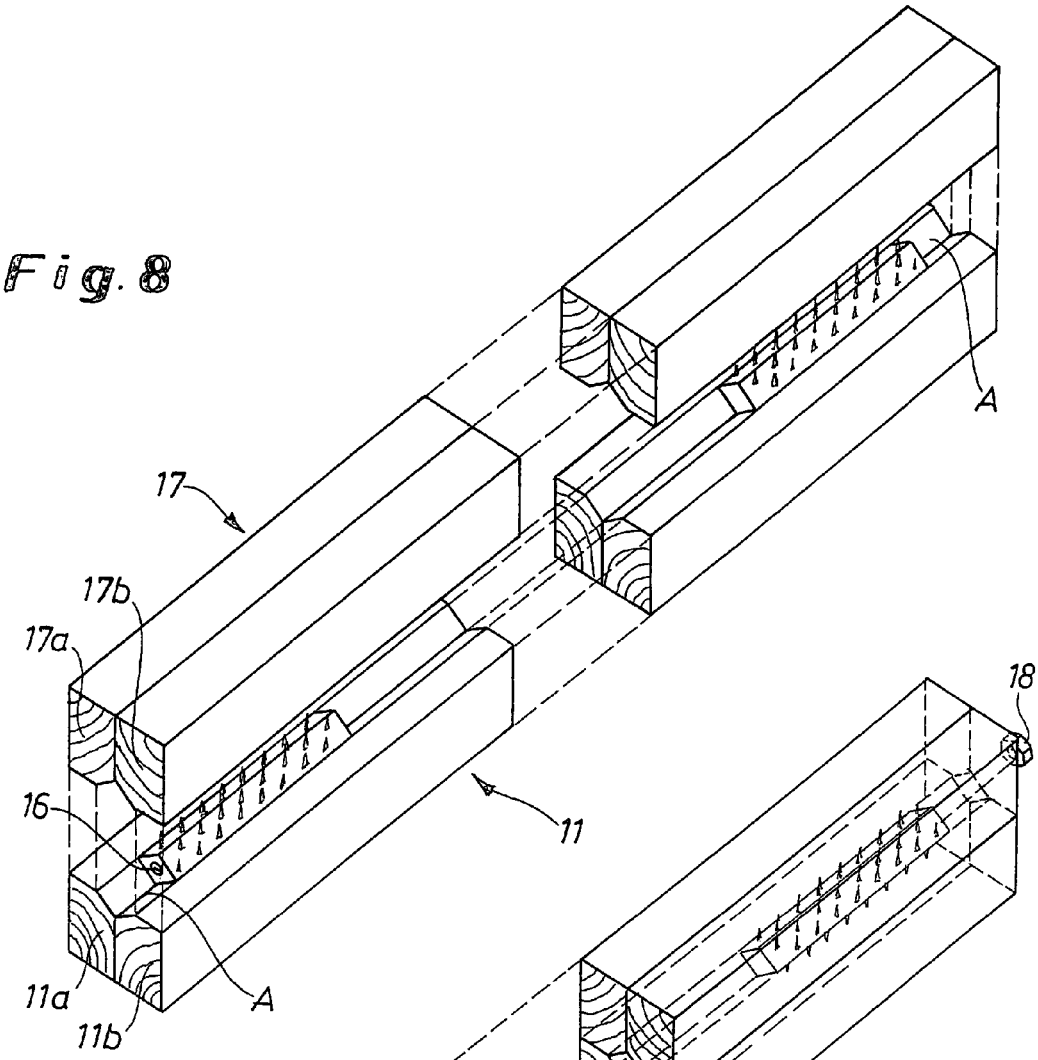
FIG. 8 another step in the joining system manufacturing process, specifically just before joining the two glued cross-beam halves.

Then in the remaining course of the process of producing the beam, an upper cross-beam half 17 consisting of two partial beam pieces 17*a* and 17*b* is assembled and glued and then, according to FIG. 8, pressed from above onto the lower cross-beam half 11 prepared according to FIG. 7 and glued to it, with the mandrels 14 pressed or forced into the upper cross-beam half 7 (the "antipodes" of the mandrels having already been pressed into the lower cross-beam half 11 in this representation). As mentioned above, it is advisable to pre-drill the beam halves according to the pattern of shear connector mandrels.

Figure 9:
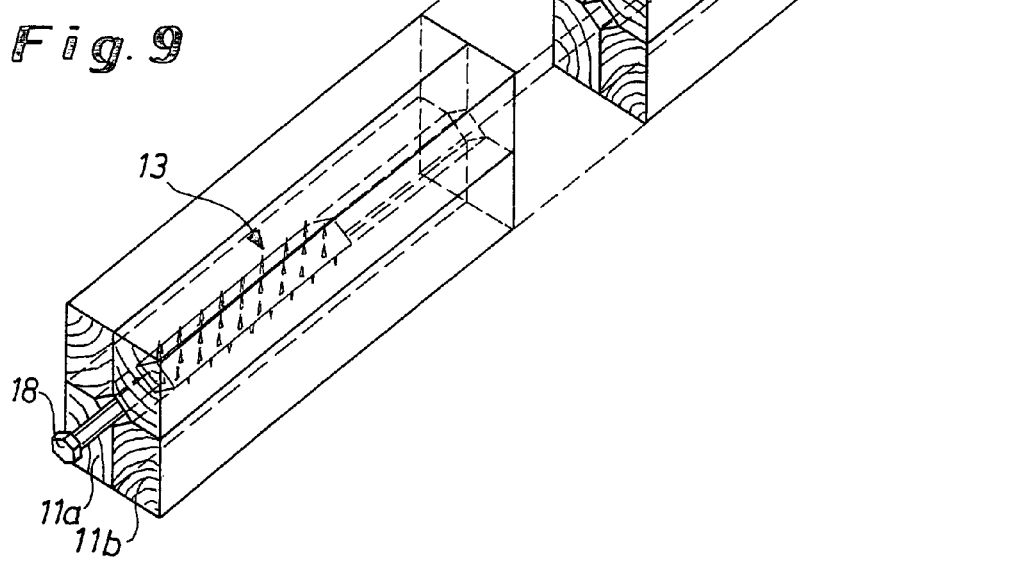
FIG. 9 the finished cross-beam with the shear connectors inserted and connection options at the ends.

After the end of the pressing and gluing operation, this yields the joining system according to this invention as illustrated in FIG. 9, where the two shear connectors 13 at the end have been shown visibly for the purpose of illustration. Moreover, FIG. 9 shows one possibility for an end connection to the shear connectors 13 in the form of a hexagonal-head screw 18 screwed into the recess 16, which has been provided with an inside thread. As already explained elsewhere, modifications of the end of the shear connector itself as well as the connecting elements optionally to be mounted on it. In particular, each shear connector may optionally be provided with a continuous inside thread running perpendicular to the longitudinal axis, which then permits additional directionally modifiable connecting options, e.g., in the form of threaded spindles running obliquely and/or transversally.

Figure 10:
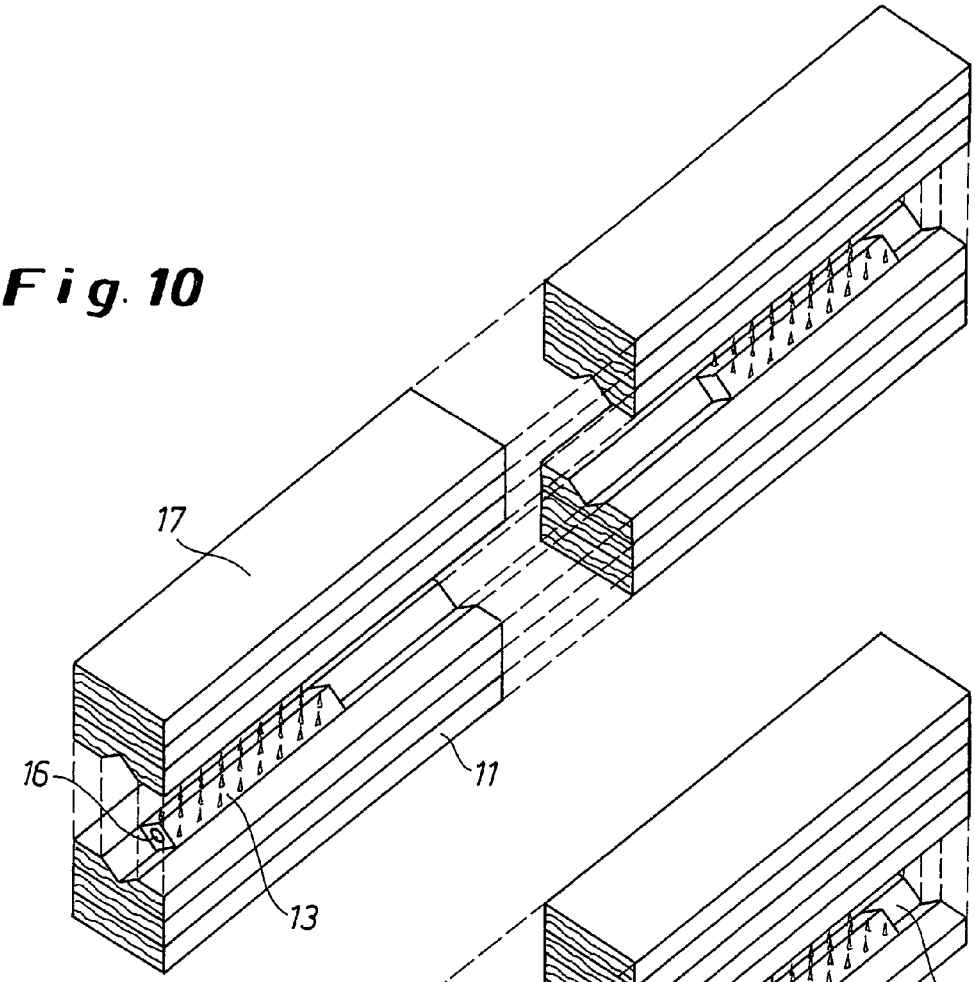
FIG. 10 a diagram corresponding to FIG. 8 on the example of a glued laminated girder.
Figure 11:
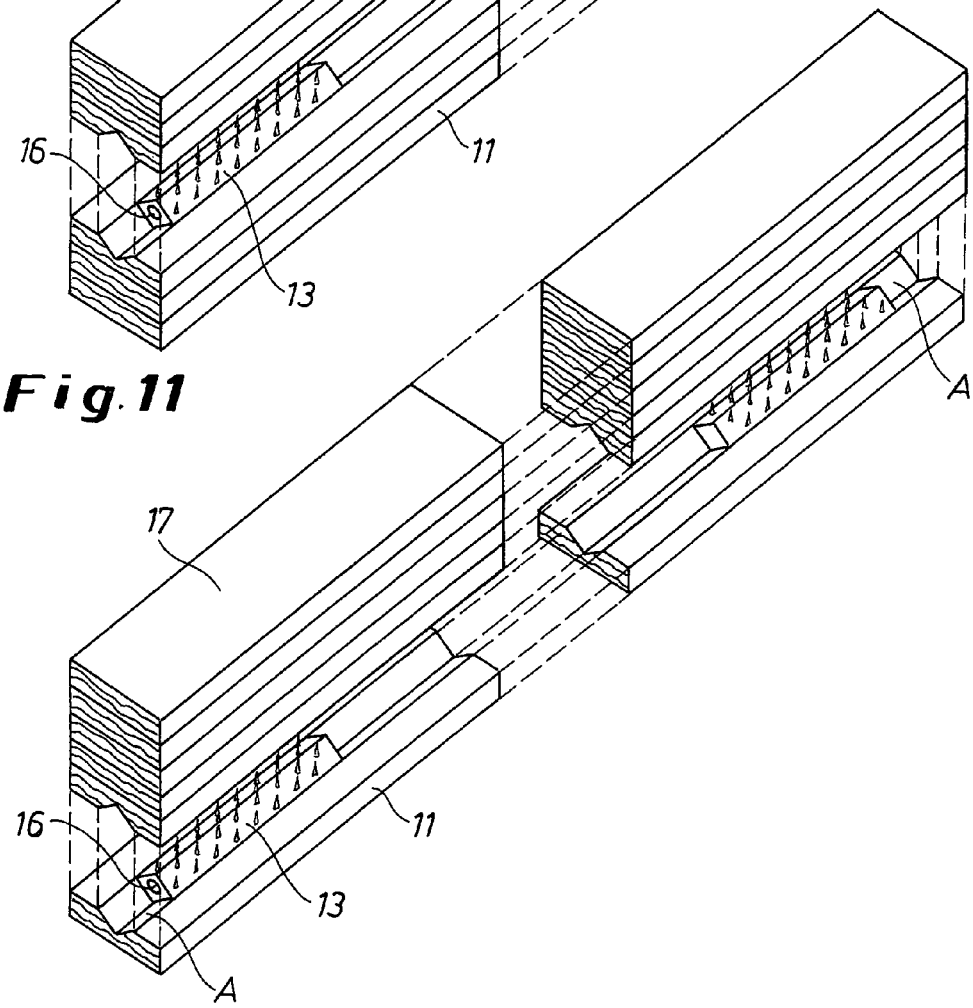
FIG. 11 an installation situation where the shear connectors have been inserted outside the longitudinal middle axis (asymmetrically with the cross section of the beam)

FIGS. 10 and 11 show an additional possible application of the present invention, namely on the example of a glued laminated girder 11, 17, which must first also be provided with the channel 12, which is present anyway in the cross-beam, by means of corresponding cutting and machining methods before insertion of shear connector 13. Otherwise, the measures described previously for producing the finished beam 11/17 are applicable accordingly, with the difference in comparison with the cross-beam being that the two beam halves 11 and 17 are constructed in layers in the case of the glued laminated girder.

FIG. 11 shows another variant, where the shear connectors 13 are arranged not symmetrically in the beam cross section but instead are arranged eccentrically, which can prove to be advantageous in certain load cases, because then the shear connectors 13 can be placed in the tension zone, depending on the load situation, so that there can be a corresponding influence on the connecting point to dissipate the supporting forces.

Figure 12:
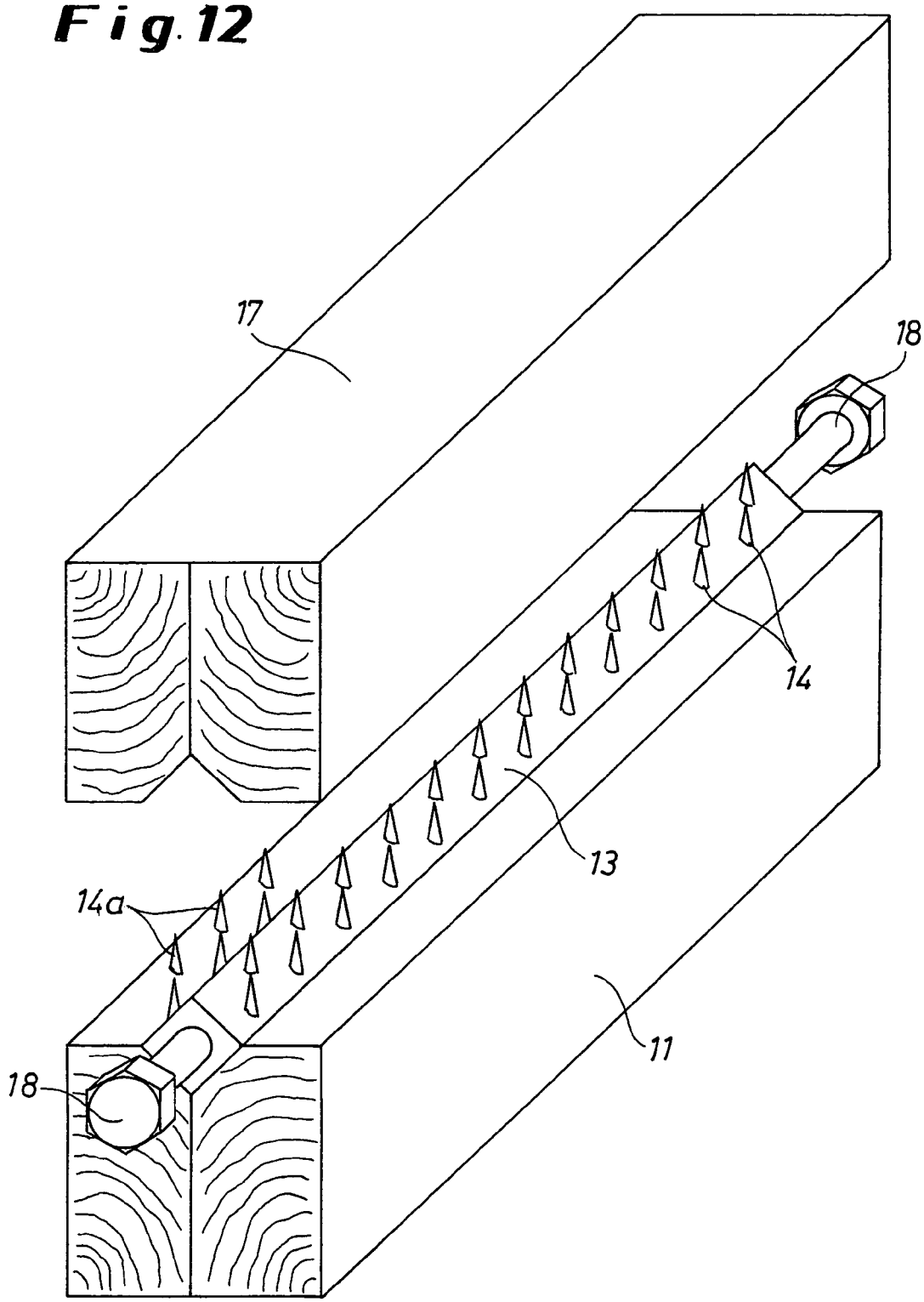
FIG. 12 an exploded diagram of a relatively shot cross-beam with a continuous shear connector, in a sectional diagram not showing the "forward wood"

FIG. 12 shows a relatively short cross-beam 11/17 shortly before completion of the joining system, provided with a continuous shear connector 13, but to simplify the diagram, only one row of mandrels 14 is shown completely, as in FIGS. 7, 8 and 9 discussed above, and the "forward wood" is not shown at all, and also for reasons of simplicity, only a few mandrels 14*a* are shown of the row on the adjacent inclined face (the core of the shear connector shown here has a square cross section).

Figure 13:
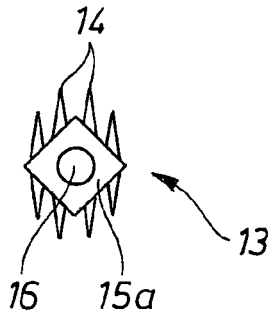
FIGS. 13*a* through 13*e* various cross-sectional shapes of the shear connector cores.
Figure 13:
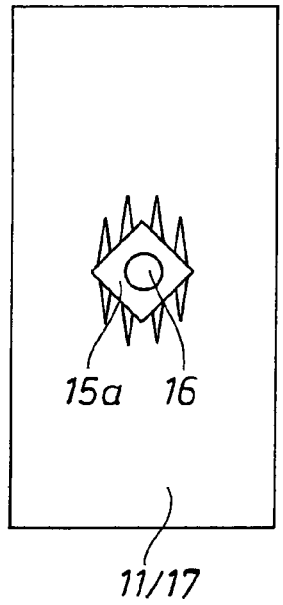
Figure 13:
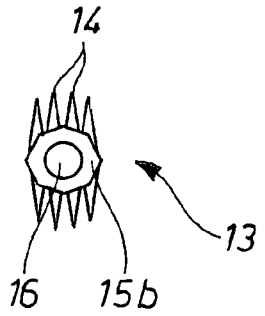
Figure 13:
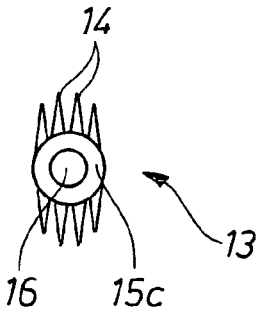
Figure 13:
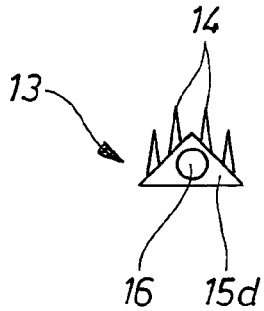

FIG. 13 shows a few possible core cross sections, namely FIG. 13*a* showing a square core cross section 15*a*, and FIG. 13*b* showing schematically the insertion into a beam 11/17 in an end view.

FIG. 13*c* shows an octagonal cross section 15*b*, while FIG. 13*d* shows an annular cross section 15*c*, and FIG. 13*e* shows a triangular cross section 15*d*. In all the end views in FIG. 13, the possible connection to the shear connector 13 is indicated in the form of an inside thread 16.

In addition, FIG. 13 shows one possibility of parallel orientation of the mandrels 14, namely half of them perpendicularly upward and the other half of them perpendicularly downward in the opposite direction, and in this case the pressing forces required to join the two beam halves run in the direction of the longitudinal axis of the mandrels 14. The triangular shape according to FIG. 13 can be recommended in particular, where the lower half of the beam is designed flat on the glued face. Of course, however, mandrels 14 pointing downward may also be provided with a triangular cross section.

Figure 14:
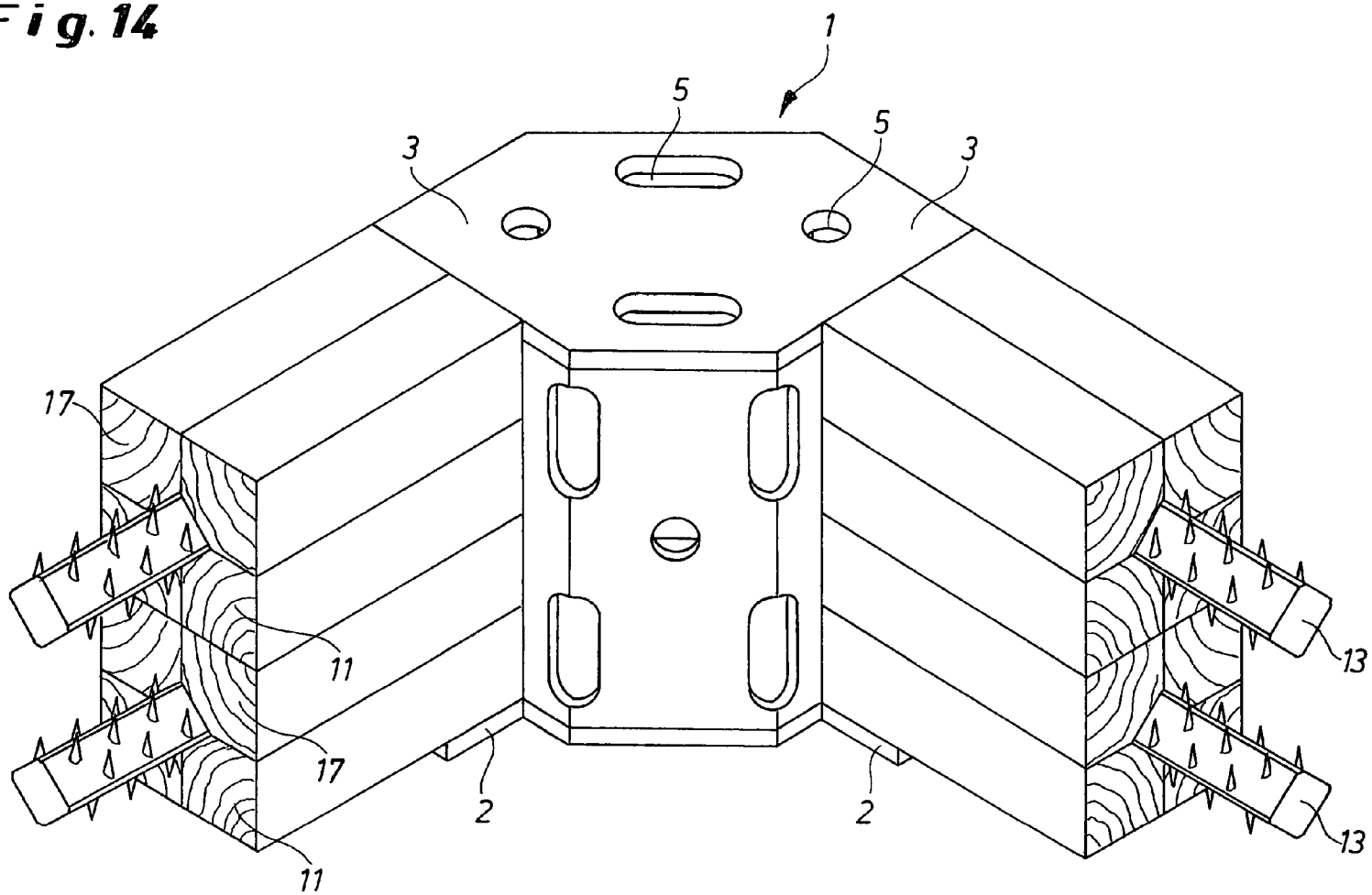
FIG. 14 a perspective diagram of a connecting node with two pairs of cross-beams (shown cut off) held at an angle to one another, with each pair consisting, of two cross-beams placed together with one shear connector each.

FIG. 14 shows especially impressively the enormous possible variations according to this invention on the example of a special node point, with four cross-beams 11/17 being joined together by a connecting part 1 according to this invention, two of them being oriented in parallel and one on top of the other, with the two pairs 30 running at right angles to one another, as is typically the case in the corner area of a ceiling (see also FIG. 4). The shear connector 13—connectors are provided in each beam in the manner described above—are shown projecting beyond the end face of the beams in the embodiment shown 35 here for the purpose of illustration; in practical use, the beams would of course be much longer, and the connectors at the end would be designed so that they can be attached to appropriate connecting parts 1 merely by screwing the thread heads or screws and nuts 18 tightly; due to the type of perspective diagram selected here, the connection of beams 11/17 to connecting part 1 which is performed in this manner in the embodiment illustrated in FIG. 14 is not visible, but it should be readily apparent in particular taking into account the diagrams in FIG. 1 as well as 9 and 12.

FIG. 14 also illustrates the particular advantage of the connecting parts 1 according to the present invention which is derived from the fact that the base plate 2 projects beyond the top plate 3 at the side, so that this creates a supporting surface and at the same time creates the stop face for the connected girder or beam 11/17, which in turn at least partially absorbs the reactive forces for relieving the load on the shear connectors and on the other hand at least supports, if not guarantees, an aligned orientation at the proper angle, so that even a layperson can construct a building with accurate angles without complicated plumbing of the perpendicular and handling of water levels in an extremely short period of time comparatively.

On the example of just some of the possible embodiments, the drawings illustrate, first, the simple design and, secondly, the extremely favorable and time-saving creation of the joining system, but it should be emphasized here again that, as explained in the preceding description of the figures, many different modifications, are possible without going beyond the scope of the present invention.

Figure 15:
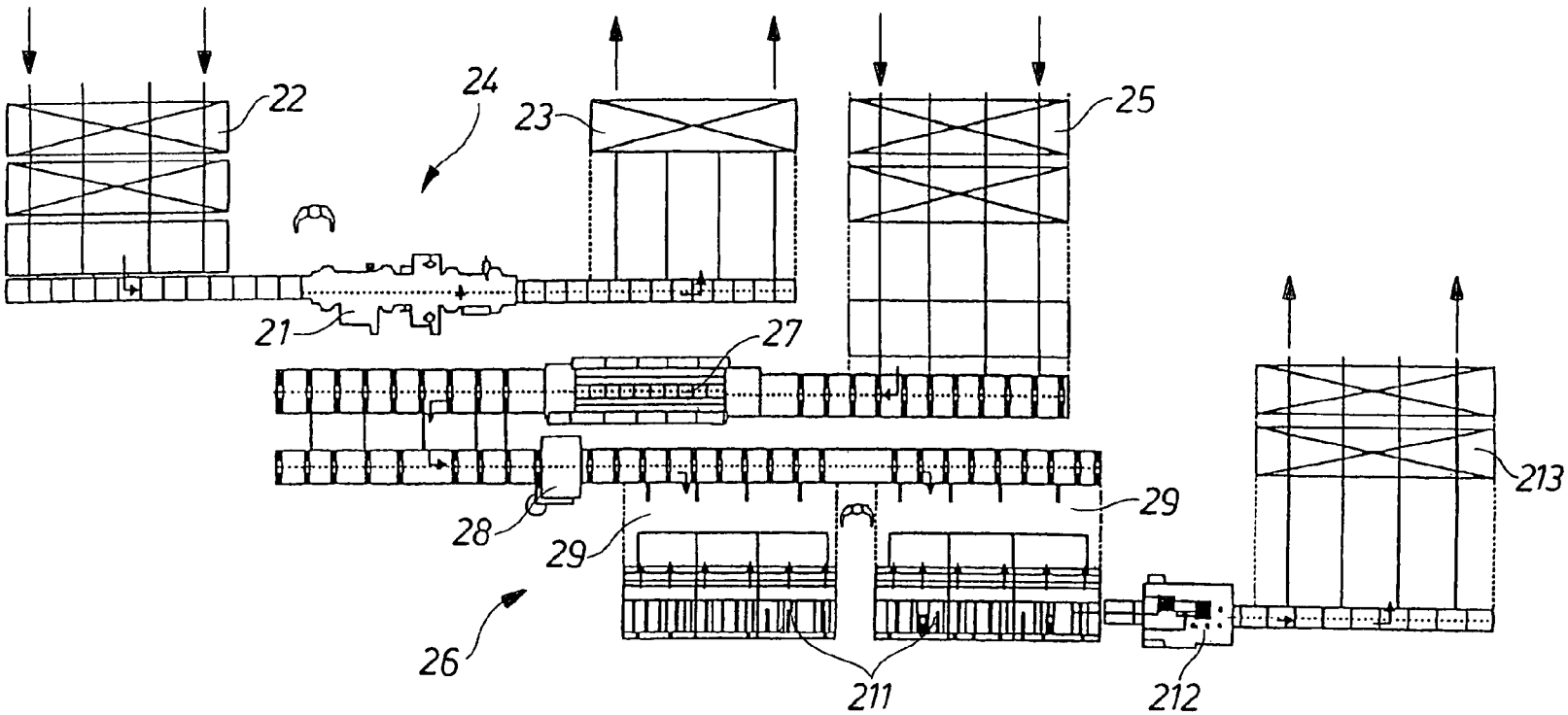
FIG. 15 a top view of an installation shown schematically.

FIG. 15 shows a preferred possibility of an installation for carrying out the process according to this invention, consisting essentially of the following parts or stations:

a planing line consisting of a planing installation 21 with a feed 22 and a delivery 23;
a package feed 25 for the press line 26;
a continuous microwave oven 27;
a gluing station 28;
a transfer and joining station 29;
a press station 211;
a glue cleaning station 212;
and a downstream depositing or delivering station 213.

The method of introducing at least one connecting element into a supporting member is carried as explained below on the example of a shear connector 214 inserted into a cross-beam 215.

The starting material for the cross-beams 215 is wooden boards having different cross-sectional dimensions, which are first planed in planing line 24 on all sides, then chamfered in appropriate locations and next cut at the center. The resulting cross-beams 125 may have any desired cross-sectional area. The resulting "quartered timbers" 216 are then removed from the production installation illustrated in FIG. 16 and sent to a drilling station 30 (not shown).

At this station, drilled holes are created in the insides 217 of the quartered timbers of cross-beam 215 so that the resulting pattern of drilled holes corresponds to the mandrel pattern of shear connector 214. These drilled holes may be provided at any desired location along the quartered timbers 216, but are preferably at one end a distance away from the end face of the beam, thus forming the "forward wood" in the end product, which increases the effect achieved with the shear connector, i.e., effectively securing it against extraction and optimizing the force cone.

Although it is also possible to press the shear connector 214 into the prepared quartered timbers 216 without first drilling a hole, inserting the shear connector into a corresponding pattern of holes offers the advantage that the wood fibers are not split, more fiber is in contact with the mandrels and thus the load-bearing capacity of the supporting members is increased considerably, e.g., by approximately 25%.

The quartered timbers 216 are then supplied over receptacle 25 to pressing line 26, where they are first heated in a continuous microwave oven 27—temperatures of approximately 90° C. to 100° C. have proven especially advantageous. Due to this heating, the subsequent gluing operation can be shortened considerably.

On the way to the gluing station 28, the quartered timbers 216 are moistened along the subsequent glue joints 218 and then glue is applied in gluing station 28. The glue is applied by means of rotating nozzles, which permit accurate metering by varying the rotational speed and the distance from the surface of the wood.

In the transfer and joining station 29, four quartered timbers 216 pretreated and drilled with holes according to the preceding discussion and at least one shear connector 214 are joined to form a cross-beam 215 having at least one connecting element. This can even be done by hand, with the two lower quartered timbers 216*a*, 216*b* being placed in a blank mold (not shown), the shear connectors 214 being dipped in a glue pot and inserted into the hole pattern(s) of the lower quartered timbers 216*a*, 216*b*. Then the similarly pretreated and drilled upper quartered timbers 216*c*, 216*d* are placed on the lower quartered timbers 216*a*, 216*b* including the shear connector(s) 214 with an accurate fit, with the pattern(s) of drilled holes provided there matching the mandrel pattern of the shear connector(s). The shear connector 214 can of course also be inserted by machine, as explained below on the basis of FIGS. 16, 17*a, b* and 19.

Figure 16:
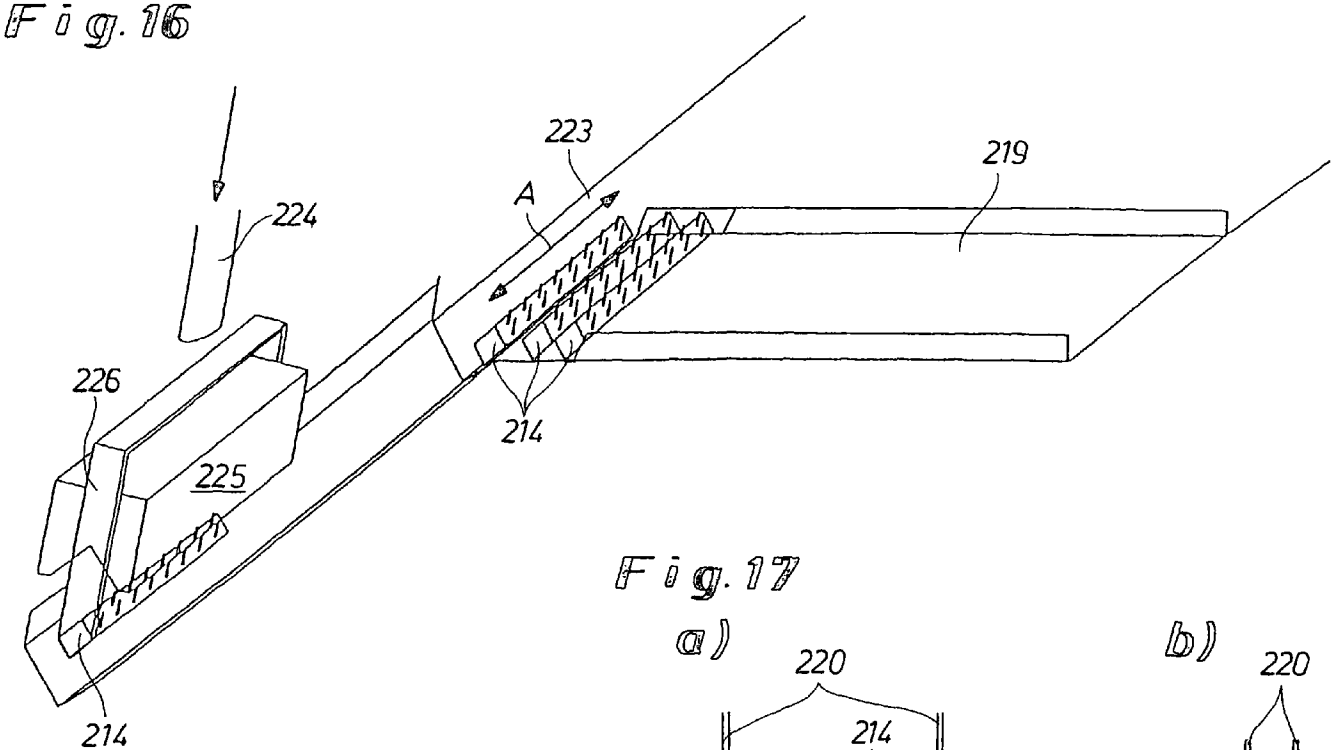
FIG. 16 part of a joining station of an inclined feed as part of the installation according to FIG. 1.
Figure 17:
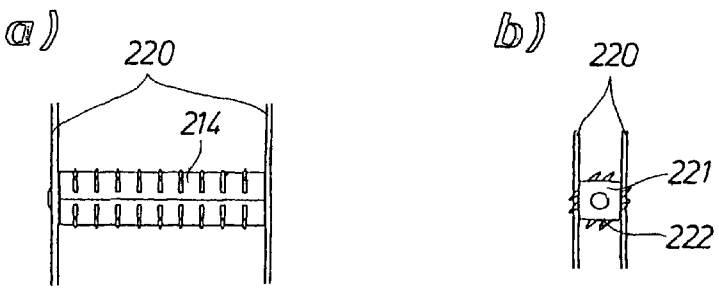
FIGS. 17*a* and *b* details of the inclined feed for shear connectors.

FIG. 16 shows the joining station 29 in a schematic perspective side view. This station consists of a feed chute 219 which according to FIG. 17 runs at an angle of 45° to the bottom for reasons to be explained below, and its grating-like bottom is itself formed by multiple round rods 220 running in the feed direction with a space between them. This type of feed has been selected for the preferred case when shear connector 214 consists of a core 221 with projecting mandrels 222, which then grip between the rods in the manner illustrated in FIG. 17*b* and thus are guided securely. The inclined position of the feed chute 219 is derived from the fact that a support and alignment are thus achieved here on the example of a shear connector 214 with a core 221 having a square cross section, so that the 25 mandrels 222 which are later to be inserted into the hole pattern in the quartered timbers 216 of the supporting members then extend in the direction of the drilled hole.

In addition to the above-mentioned feed chute 219, the joining station 29 includes a repeating device 223, indicated by a double arrow A, which works together with a stamp unit 224 (see FIG. 16). Stamp unit 224 includes a stamp 225 which can move vertically up and down in the embodiment illustrated here and whose lower free end face has the negative profile of shear connector 214. Repeating device 223 is in parallel alignment on the lower end of feed chute 219. In operation, it grips the shear connectors 214 individually and transfers them to the area below the stamp 225, which accommodates the shear connectors 214 in a frictionally engaged manner due to clamping devices 226 arranged laterally on its end faces. These clamping devices 226 are designed so that they either engage in recesses there or reach around projecting areas located there, depending on the design of the end faces of the shear connectors 214. As also shown in FIG. 16, each shear connector 214 remains in the angular position determined by feed chute 219 during this transfer, i.e., aligned vertically with mandrels 222.

The stamp 225 then travels down, so that at least one shear connector 214 is inserted with its mandrels 222 into the 15 pattern of holes in the lower cross-beam half 216*a*, 216*b* produced from two quartered timbers 216*a* and 216*b*. This device is adjusted so that the stamp 225 travels only until it is in contact with the upper end face of the lower beam half 216*a*, 216*b*, i.e., to the extent that the mandrels 222 20 are inserted completely into the material, but there can be no destruction due to the core 221 being pressed into the material of the beam. Thus, due to the mutual allocation and interaction of the feed chute 219, the repeating device 223 and the stamp unit 224, an accurate alignment and centering of the shear connectors 214 relative to the lower beam half 216*a*, 216*b* is guaranteed.

The process sequence according to this invention can also be carried out without predrilling holes in the quartered timbers 216—if the connecting elements 214 are to be inserted into a supporting member made of a softer material than the connecting elements 214 themselves. In this case, the stamp 225 must be dimensioned so that the mandrels 222 can be inserted into quartered timbers 216.

Figure 18:
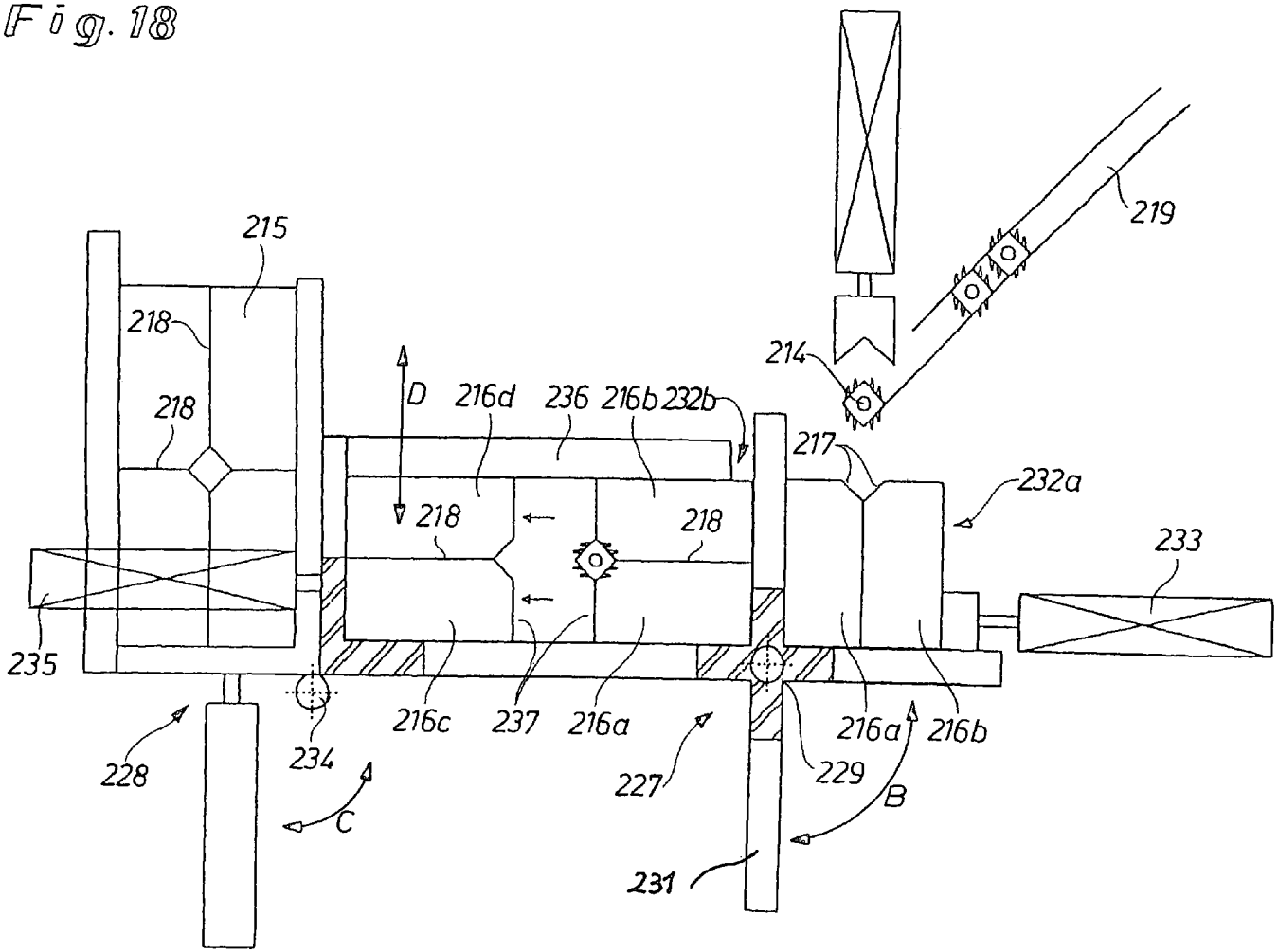
FIG. 18 a cross-sectional view of the joining station.

The additional function of the automatic joining station 29 according to FIG. 16, which is implemented here in multiple stages and is integrated into the overall process, is derived from the representation in FIG. 18. In the embodiment illustrated here, the joining station 29 consists of two main areas which are formed by a pivoting and/or rotating longitudinal path and receptacle 227 and a swivel receptacle 228. For this multiple-stage joining station 29, multiple feed chutes 219 (magazines) and stamp units 224 distributed in the longitudinal direction may be provided, which permits economical production of multiple 10 supporting members at the same time. Therefore, the quartered timbers 216 are processed to yield a length such that several supporting members 215 are formed from them by cutting the assembled and glued timbers across the longitudinal axis. The shear connectors 214 are arranged so they are distributed over the length so that after cutting, there is one shear connector 214 in or near each end area of the individual supporting members 215.

The one pivotable longitudinal receptacle 227 of the joining station 29 consists of a cross 231 which can rotate about a longitudinal axis 229 and preferably has four receptacle quadrants 232*a, b, c, d*.

According to the diagram in FIG. 18, the above-mentioned insertion of shear connector 214 into lower cross-beam part 216*a*, 216*b*, which is prefabricated to this extent, takes place in the upper right quadrant 232*a*. The quartered timbers 216*a*, 216*b* may already be glued and pressed (curing of glue under pressure). The lower cross-beam part 216*a*, 216*b* is held in position by a pressure cylinder 233 at the side.

As soon as the shear connector(s) 214 has/have been inserted into the lower beam half 216*a*, 216*b*, the rotating cross 231 is rotated 90° counterclockwise (see curved arrow B) until reaching the position illustrated in the upper left quadrant 232*b*. At this time, an "upper" beam half 216*c*, 216*d* assembled in a manner similar to that described for the lower beam half 216*a*, 216*b* and optionally also glued and pressed is guided by the left swivel receptacle 228, which is aligned parallel to rotating cross 231, so that it is brought into the position shown in the middle part of FIG. 18 by an appropriate clockwise swivelling motion (curved arrow C) about the axis of rotation 234, so that the two beam halves 216*a, b* and 216*c, d* are opposite one another in a horizontal plane. The upper beam half 216*c*, 216*d* is pressed in a horizontal direction against the lower beam half 216*a, b* by means of another pressure cylinder 235 which is fixedly connected to the left swivel receptacle 228 and thus also executes the swivelling motions, whereby a plate 236 which is adjustable according to double arrow D is provided on the left swivel receptacle 228 in order to permit adjustment of the various beam dimensions. By operating the pressure cylinder 235, the "upper" beam half 216*c, d* is pushed to the right onto the lower beam half as far as the two end faces 237 on both sides, so that the projecting mandrels 222 of the shear connector(s) 214 are then also inserted into the upper beam half 216*c, d*, or if there is no existing pattern of holes, the mandrels are pressed into the material. The beam surfaces 237 which are to be brought in contact are coated with glue.

The U-shaped swivel receptacle 228 on the left, whose one side is formed by adjustable plate 236, is then swivelled 90° counterclockwise (curved arrow C) about its axis of rotation 234, thus achieving the upright position shown in the left part of FIG. 18. This also shows clearly that the pressure cylinder 235 also executes the swivelling motion.

After being assembled, the complete wooden beam 215 with the shear connector 214 inserted is automatically lifted into a press where the beams are glued. In the embodiment described here, the complete wooden beam 215 with the shear connector 214 inserted is automatically lifted into a press where the beams are glued. In the embodiment described here, the gluing is performed in 5-minute cycles at pressures of up to 210 bar. If no continuous microwave oven 27 is provided in the production line, a longer pressing operation is necessary, which can be carried out in special pressing stations that accommodate multiple beams.

After gluing, the cross-beams 215 are also cleaned in a glue cleaning device 212.

It has proven to be especially advantageous to produce cross-beam parts 215 with a length of one meter and with a shear connector 214 inserted at one end, and then two of these cross-beam parts can be assembled subsequently to form a supporting member of any desired length with connection options on each side; this is performed on a jointing installation by inserting a cross-beam intermediate piece of any desired length, having no shear connector 214. It is also possible to insert two intermediate pieces, i.e., to perform three jointing steps. Essentially beams up to 12 meters long can be produced in this way, with a cross section of 10×10 cm, 10×20 cm or 12×24 cm, for example.

After the final curing of the adhesive, any desired known further processing steps are possible, such as planing or chamfering or other machining operations or preparation for 30 assembly.

The installation described above with its process steps represents only one possibility of manufacturing the beams according to this invention. In particular, parts may be omitted, supplemented, replaced and/or combined to form new manufacturing lines, adapted to the given conditions.

The following process steps are essential for the shear connector technology according to this invention:

In particular, cross-beam quartered timbers or cross-beam halves, which were previously glued together from two cross-beam quartered timbers and have already been hollowed out accurately to the required dimensions and coated with glue, are predrilled at defined locations in a CNC-controlled automatic drilling machine according to the shear connector mandrel pattern in an accurate manner.

The cross-beam quartered timbers or halves, preferably precut on one side to approximately the finished length and precut on the other side to exactly the finished length preferably pass through a gluing station, downstream from which the shear connectors which have been dipped in glue are inserted into the pattern of holes.

In the press, the cross-beams with the shear connectors already inserted are glued and then cut or trimmed accurately to the exact finished dimension. After this process, a fine planing of the outside surfaces is performed. It is found that with an optimum arrangement of successive production steps, the final processing steps are limited to accurate trimming of the wooden beams and the final all-round planing of the finished cross-beam.

Use of glued laminated girders is also possible, in which case several shear connectors may also be inserted into a beam one above the other due to the sandwich structure, like the design of several cross-beams, each provided with a shear connector and arranged one above the other (see FIG. 14).

This opens up numerous possible variations, including the construction of cross-beams with internal shear connectors, such that the cross-beams not only have a dimensional stability comparable to that of steel structures but they are actually superior with regard to fire prevention. Due to the above-mentioned accurate determination of the position of the shear connector in the longitudinal axis in combination with the very accurate determination of the cross-beam opening which is now possible, this creates a satisfactory possibility of connection to structural parts that are essentially in terms of the statics, e.g., to steel node points according to this invention.

What is claimed is:

1. A wooden beam, comprising:

at least two supporting members at least partially made of wood and defining together a continuous hollow cavity; and at least one shear connector having a core and a plurality of mandrels projecting from the core in a direction transverse to a longitudinal extent of the shear connector, located in the hollow cavity, the shear connector having an outside end thereof set back with respect to an adjacent end face of the beam by a length corresponding to a forward wood length, $a_{1,t}$, defined by an equation $$a_{1,t} \geq \frac{Rk \cdot \gamma_M \text{wood}}{\gamma_M \text{steel} \cdot f_{v,k} \cdot (2 \cdot t_1 + a_2)} - a_1 \cdot (n-1),$$

wherein Rk is a characteristical load bearing capacity of a totality of mandrels at an end section of the beam where the shear connector is located, $\gamma_M$ wood is a reduction coefficient during bending of wood, $\gamma_M$ steel is a reduction coefficient during bending of steel, $f_{v,k}$ is stress at break at the flanks of a shear block that is defined by a profile of the shear connector, $t_1$ is an operational length of a mandrel, $a_1$ is a distance between adjacent mandrels in a longitudinal direction of the shear connector, $a_2$ is a distance between adjacent mandrels in a direction transverse to the longitudinal extent of the shear connector, and n is a number of mandrels arranged one after another in a direction of wood fibers.

2. A wooden beam according to claim 1, comprising two shear connectors located in the hollow cavity and arranged at opposite ends of the beam, respectively, wherein at least one of the two shear connectors corresponds to the at least one shear connector.

3. A wooden beam according to claim 2, further comprising a rod arranged in a center of the beam end linking the two shear connectors.

4. A wooden beam according to claim 2, wherein the two shear connectors lie symmetrically with respect to each other.

5. A wooden beam according to claim 2, wherein the two shear connectors are arranged parallel to each other.

6. A wooden beam according to claim 1, wherein the at least one shear connector extends substantially throughout an entire length of the beam.

7. A wooden beam according to claim 1, wherein the at least one shear connector is located in the tension zone.

8. A wooden beam according to claim 1, wherein the two shear connectors lie in at least one plane of symmetry.

9. A wooden beam according to claim 1, wherein the beam is formed as a cross-beam.

10. A wooden beam according to claim 1, wherein the beam is formed as a glued laminated girder.

11. A wooden beam according to claim 1, wherein the shear connector has at least one of an inside thread and an outside thread.

12. A wooden beam according to claim 1, wherein the shear connector provides for connection options in three direction with respect to an axis of the wooden beam.

13. A wooden beam according to claim 1, wherein the shear connector is formed of a material selected from the group consisting of: iron, cast iron, cast steel; brass aluminum, ceramic, and sheet metal.

* * * * *